US005188676A

United States Patent [19]

Taylor

[11] Patent Number: 5,188,676

[45] Date of Patent: Feb. 23, 1993

[54] METHOD FOR ANNEALING ZIRCALOY TO IMPROVE NODULAR CORROSION RESISTANCE

[75] Inventor: Dale F. Taylor, Schenectady, N.Y.

[73] Assignee: General Electric Company, Schenectady, N.Y.

[21] Appl. No.: 749,052

[22] Filed: Aug. 23, 1991

[51] Int. Cl.[5] ..... C22F 1/00

[52] U.S. Cl. ..... 148/217; 148/672

[58] Field of Search ..... 148/11.5 F, 133, 20.3, 148/672, 217

[56] References Cited

U.S. PATENT DOCUMENTS 4,238,251 12/1980 Williams et al. ..... 148/133
4,450,016 5/1984 Vesterlund et al. ..... 148/11.5 F
4,512,819 4/1985 Steinberg ..... 148/133
4,521,259 6/1985 Eucken ..... 148/11.5 F
4,636,267 1/1987 Jacobsen et al. ..... 148/133
4,647,317 3/1987 Rosecrans ..... 148/11.5 F
4,648,912 3/1987 Sabol et al. ..... 148/11.5 F
4,881,992 11/1989 Bunel et al. ..... 148/133

*Primary Examiner*—Upendra Roy
*Attorney, Agent, or Firm*—James E. McGinness; James Magee, Jr.

[57] ABSTRACT

A method for annealing a Zircaloy member having a cold worked or beta quenched crystal structure to mitigate the reduction in nodular corrosion resistance caused by the anneal comprises, annealing the member in an atmosphere comprising oxygen and the balance an inert atmosphere to form an adherent black oxide on the member.

8 Claims, 3 Drawing Sheets

METHOD FOR ANNEALING ZIRCALOY TO IMPROVE NODULAR CORROSION RESISTANCE

BACKGROUND OF THE INVENTION

This invention relates to annealing members formed from Zircaloy 2 or Zircaloy 4 alloys to reduce the susceptibility of the member to nodular corrosion.

Nuclear fuel element cladding serves several purposes and two primary purposes are: first, to prevent contact and chemical reactions between the nuclear fuel and the coolant or the moderator if a moderator is present; and second, to prevent the radioactive fission products, some of which are gases, from being released from the fuel into the coolant or the moderator. The failure of the cladding, i.e., a loss of the leak-proof seal, can contaminate the coolant or moderator and the associated systems with radioactive long-lived products to a degree which interferes with plant operation.

Zirconium-based alloys have long been used in the cladding of fuel elements in nuclear reactors. A desirable combination is found in zirconium by virtue of its low thermal neutron cross-section and its generally acceptable level of resistance to corrosion in a boiling water reactor environment. Zircaloy 2, a zirconium alloy consisting of about 1.2 to 1.7 percent tin, 0.07 to 0.2 percent iron, 0.05 to 0.15 percent chromium, 0.03 to 0.08 percent nickel, up to 0.15 percent oxygen, and the balance zirconium, has been used in reactor service, but possesses some deficiencies that have prompted further research to improve performance. Zircaloy 4 was one alloy developed as a result of further research to improve Zircaloy 2. Zircaloy 4 is similar to Zircaloy 2 but contains less nickel (0.007% max. wt. percent) and slightly more iron. Zircaloy 4 was developed as an improvement over Zircaloy 2 to reduce absorption of hydrogen in Zircaloy 2. Zircaloy 2 and Zircaloy 4 are herein referred to as the Zircaloy alloys or Zircaloy. The Zircaloy 2 and Zircaloy 4 alloys are disclosed in U.S. Pat. Nos. 2,772,964 and 3,148,055, both incorporated herein by reference.

The Zircaloy alloys are among the best corrosion resistant materials when tested in water at reactor operating temperatures, typically about 290° C., but in the absence of radiation from the nuclear fission reaction. The corrosion rate in water at 290° C. is very low and the corrosion product is a uniform, tightly adherent, black $ZrO_2$ film. In actual service, however, the Zircaloy is irradiated and is also exposed to radiolysis products present in reactor water. The corrosion resistance properties of Zircaloy deteriorate under these conditions and the corrosion rate thereof is accelerated.

The deterioration under actual reactor conditions of the corrosion resistance properties of Zircaloy is not manifested in merely an increased uniform rate of corrosion. Rather, in addition to the black $ZrO_2$ layer formed, a localized, or nodular corrosion phenomenon has been observed in some instances on Zircaloy tubing in boiling water reactors. In addition to producing an accelerated rate of corrosion, the corrosion product of the nodular corrosion reaction is a highly undesirable white $ZrO_2$ bloom which is less adherent and lower in density than the black $ZrO_2$ layer.

The increased rate of corrosion caused by the nodular corrosion reaction will be likely to shorten the service life of the tube cladding, and also this nodular corrosion will have a detrimental effect on the efficient operation of the reactor. The white $ZrO_2$, being less adherent, may be prone to spalling or flaking away from the tube into the reactor water. On the other hand, if the nodular corrosion product does not spall away, a decrease in heat transfer efficiency through the tube into the water is created when the nodular corrosion proliferates and the less dense white $ZrO_2$ covers all or a large portion of a tube.

Actual reactor conditions cannot be readily duplicated for normal laboratory research due to the impracticality of employing a radiation source to simulate the irradiation experienced in a reactor. Additionally, gaining data from actual use in reactor service is an extremely time consuming process. For this reason, there is no conclusory evidence in the prior art which explains the exact corrosion mechanism which produces the nodular corrosion. This limits, to some degree, the capability to ascertain whether new thermal or mechanical treatments of members formed from Zircaloy will be susceptible to nodular corrosion before actually placing the members into reactors.

Laboratory tests conducted under the conditions normally experienced in a reactor at approximately 300° C. and 1000 psig in water, but absent radiation, will not produce a nodular corrosion product on Zircaloy alloys like that found in some instances on Zircaloy alloys which have been used in reactor service. However, if steam is used with the temperature increased to over 500° C. and the pressure raised to 1500 psig, a nodular corrosion product can be produced on Zircaloy alloy samples in laboratory tests. Such testing in steam at 500° C. and 1500 psig to as the high-pressure steam test.

Research efforts directed at improving the corrosion properties of Zircaloy have yielded some advances. Corrosion resistance has been enhanced in some instances through carefully controlled heat treatments of the alloys either prior to or subsequent to material fabrication. For example, it was found that a high cooling rate from the beta or alpha-plus-beta range provides what is known as a beta-quenched crystal structure having good nodular corrosion resistance in the high-pressure steam test. Subsequent hot working or alpha annealing, such as recovery, partial recrystallization, or full recrystallization annealing after cold working decrease the nodular corrosion resistance of the beta-quenched structure.

It is known that improved nodular corrosion resistance is obtained when Zircaloy has been cold worked or quenched from the beta or alpha-plus-beta range, but the cold worked or beta-quenched structures are detrimental to other properties such as ductility, creep resistance, and toughness. A compromise to obtain mechanical properties and corrosion resistance is provided with the beta-quench prior to the final cold rolling and anneal. U.S. Pat. Nos. 4,450,016 and 4,450,020 disclose Zircaloy fuel cladding tubes formed by beta-quenching prior to a cold rolling, after which an anneal is performed at a temperature of 500° to 610° C. in vacuum. The cumulative time and temperature of each successive anneal after the beta-quench improves the creep and the uniform corrosion resistance, but unfortunately decreases the nodular corrosion resistance in the high-pressure steam test, see "Influence of Variations in Early Fabrication Steps on Corrosion, Mechanical Properties, and Structure of Zircaloy-4 Products," D, Charquet, E. Steinberg, Y. Miller, Zirconium in the Nuclear Industry: Seventh International Symposium, ASTM STP 939, American Society for Testing and Materials, 1987, pp 431–447.

For example, Charquet et al. disclose a cumulative annealing parameter that is a function of annealing time, temperature, and an emperically determined activation energy. FIG. 1, reproduced from the Charquet et al. disclosure, shows that as the annealing parameter increases for fully recrystallized material, the resistance to nodular corrosion substantially decreases. Zircaloy in the cold worked or as pilgered condition maintains a high resistance to nodular corrosion; however, the mechanical properties are not suitable for use as cladding for nuclear reactor fuel. The cold worked Zircaloy must be annealed to recover, partially recrystallize, or fully recrystallize the material to achieve the desired mechanical properties.

It is an object of this invention to provide a method for mitigating the reduction in nodular corrosion resistance of Zircaloy alloy members that are annealed.

BRIEF DESCRIPTION OF THE INVENTION

I have discovered a method for annealing a Zircaloy member having a cold worked or beta quenched crystal structure that mitigates the reduction in nodular corrosion resistance caused by the anneal. The method comprises annealing the member in an atmosphere comprised of oxygen and the balance an inert atmosphere to form an adherent black oxide on the member. As used herein, the term "balance an inert atmosphere" means the remainder of the atmosphere is an atmosphere that does not react with the Zircaloy alloy, such as argon, helium, or mixtures thereof. Atmospheres that react with the Zircaloy alloys, such as hydrogen, nitrogen, and water are limited to impurity levels that do not reduce the corrosion resistance of the member. Preferably, the atmosphere is limited to less than about 2 parts per million hydrogen, 20 parts per million nitrogen, and 10 parts per million water.

DETAILED DESCRIPTION OF THE INVENTION

We have discovered a method of annealing a Zircaloy member having a cold worked or beta quenched crystal structure that does not reduce the nodular corrosion resistance of the annealed member. Instead, the nodular corrosion resistance found in the cold worked or beta quenched crystal structure is substantially maintained or improved in Zircaloy members annealed according to the method of this invention. This is contrary to the teaching of those skilled in the art, that each successive anneal after cold working or beta quenching reduces the nodular corrosion resistance of Zircaloy members.

Figure 1:
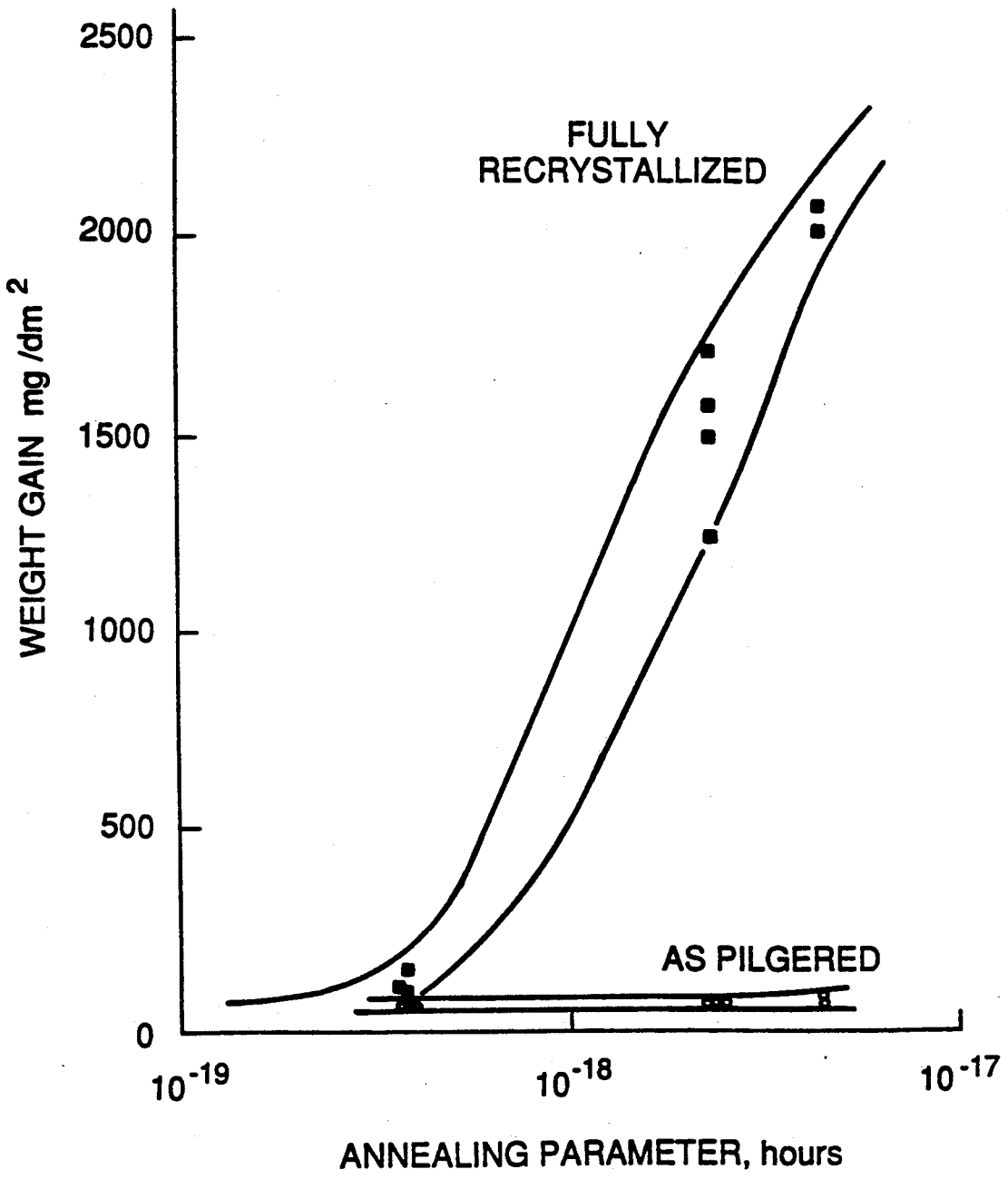
FIG. 1 is a graph showing the corrosion weight gain on samples of Zircaloy tubing that have been high-pressure steam tested in the as pilgered and fully recrystallized condition.
Figure 2:
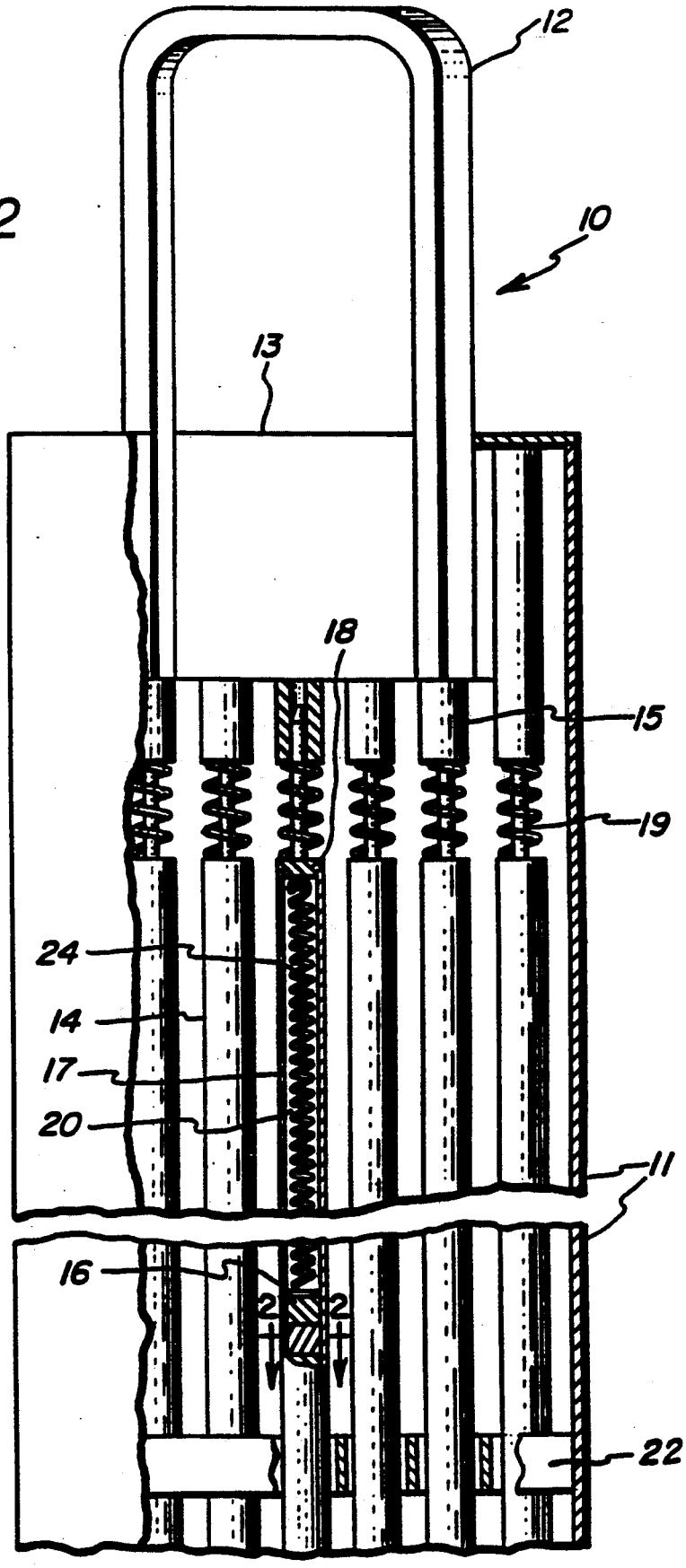
FIG. 2 is a partial cutaway side view of a nuclear fuel rod assembly.

Examples of Zircaloy members that can be annealed by the method of this invention are shown by referring to FIG. 1. FIG. 2 shows a partially cutaway sectional side view of a nuclear fuel assembly 10. The fuel assembly consists of a tubular flow channel 11 of generally square cross section provided at its upper end with lifting bale 12 and at its lower end with a nose piece (not shown due to the lower portion of assembly 10 being omitted). The upper end of channel 11 is open at 13 and the lower end of the nose piece is provided with coolant flow openings. An array of fuel elements or rods 14 is enclosed in channel 11. The fuel rods 14 are supported in channel 11 by means of upper end plate 15, and a lower end plate (not shown due to the lower portion being omitted). The spacing between fuel rods 14 within channel 11 is maintained by spacer 22. The liquid coolant ordinarily enters through the openings in the lower end of the nose piece, passes upwardly around fuel elements 14, and discharges at upper outlet 13 in a partially vaporized condition for boiling reactors or in an unvaporized condition for pressurized reactors at an elevated temperature.

The nuclear fuel elements or rods 14 are sealed at their ends by means of end plugs 18 welded to the cladding 17, which may include studs 19 to facilitate the mounting of the fuel rod in the assembly. A void space or plenum 20 is provided at one end of the element to permit longitudinal expansion of the fuel material and accumulation of gases released from the fuel material. A nuclear fuel material retainer means 24 in the form of a helical member is positioned within space 20 to provide restraint against the axial movement of the pellet column, especially during handling and transportation of the fuel element. All of the members, and in particular the channel 11, spacer 22, cladding 17, and end plug 18 can be formed from Zircaloy annealed by the method of this invention.

For example, the cladding 17, or container tubing for nuclear fuel elements is manufactured by heating a Zircaloy extrusion billet to about 590° to 650° C., extruding the billet into tube shell followed by standard tube reduction and subsequent anneals at about 570° to 590° C. to achieve desired tube dimensions and mechanical properties. The standard tube reduction process for Zircaloy tubing used in nuclear fuel elements is pilger-rolling. Pilger-rolling is a tube reduction process using traveling, rotating dies on the outer tube surface to forge the tube over a stationary mandrel die inside the tube. Prior to the final tube rolling reduction, the tube is beta-quenched. After the final tube rolling reduction, the tube is annealed in vacuum or an inert atmosphere to recover, partially recrystallize, or fully recrystallize the tube and obtain the strength, ductility, creep resistance, and toughness properties required for the cladding.

For the Zircaloy alloys, recovery annealing is performed at about 400° to 490° C., partial recrystallization annealing is about 490° to 530° C., and full recrystallization annealing is greater than about 530° C. Although such final annealing provides required mechanical properties, nodular corrosion resistance is reduced. However, the nodular corrosion resistance of the annealed member is improved by performing the final annealing according to the method of this invention.

Annealing according to the method of this invention can be performed at temperatures where a uniform adherent oxide will form on the Zircaloy member, for example at temperatures above about 300° C., preferably from about 500° to 600° C. The annealing atmosphere is comprised of oxygen at a volume percent that will form a tightly adherent uniform black oxide on the Zircaloy, and the balance the inert atmosphere. For example, in a flowing atmosphere at least about 0.1 volume percent, and in a contained atmosphere at least about 0.1 gram oxygen per square meter surface area of Zircaloy is sufficient to form the tightly adherent uniform black oxide.

Tests for nodular corrosion have been conducted on Zircaloy samples annealed by the method of this invention. These tests have shown the nodular corrosion resistance of Zircaloy having a cold worked or beta-quenched crystal structure can be retained in annealed samples by forming an oxide layer on the member during the anneal. However, Zircaloy members annealed in vacuum, inert atmospheres, or inert atmospheres comprised of water, hydrogen, or nitrogen at greater than impurity levels form oxide layers that do not retain the nodular corrosion resistance.

Damage to the uniform black oxide layer formed in the anneal should be minimized, e.g., by minimizing handling after annealing of the Zircaloy member. For example, the nuclear fuel rod can be assembled by inserting the nuclear fuel and end caps in the cladding before performing the final anneal to form the oxide layer on the cladding. As a result, handling damage to the oxide layer on the cladding is minimized.

Additional features and advantages of the method of this invention are further shown by the following Example. In the following Example high-pressure steam testing was performed by exposing samples to steam at 510° C. and 1500 psig for 24 hours. In the laboratory, these same test conditions induce the formation of the nodular corrosion product on Zircaloy alloys which have been given a 750° C./48 hour anneal, and is also identical to the nodular corrosion found sometimes on Zircaloy after being used in reactor service.

EXAMPLE I

A Zircaloy-2 plate comprised of, in weight percent, about 1.55 percent tin, about 0.16 percent iron, about 0.12 percent chromium, about 0.05 percent nickel, and the balance substantially zirconium was formed into a plate by the following thermomechanical treatment. The plate was formed by forging an ingot at 1016° C. to form a 7.65 inch square cross section, soaking the forged ingot at 1038° C. and annealing at 788° C. in air. The forging was machined to a 7.3 inch square cross section and rolled at 788° C. to 9.5 inches wide, cross rolled at 788° C. to a 0.8 inch by 9.5 inch cross section strip, and annealed in air at 788° C. for one hour. The strip was rolled at 427° C. to a 0.5 inch by 9.5 inch cross section sheet. The sheet was forge flattened at 427° C., and sand blasted and pickled to clean the surface. Coupons about 0.75 by 0.5 by 0.25 inch were cut from the sheet by electric discharge machining.

Figures 3, 4, 5:
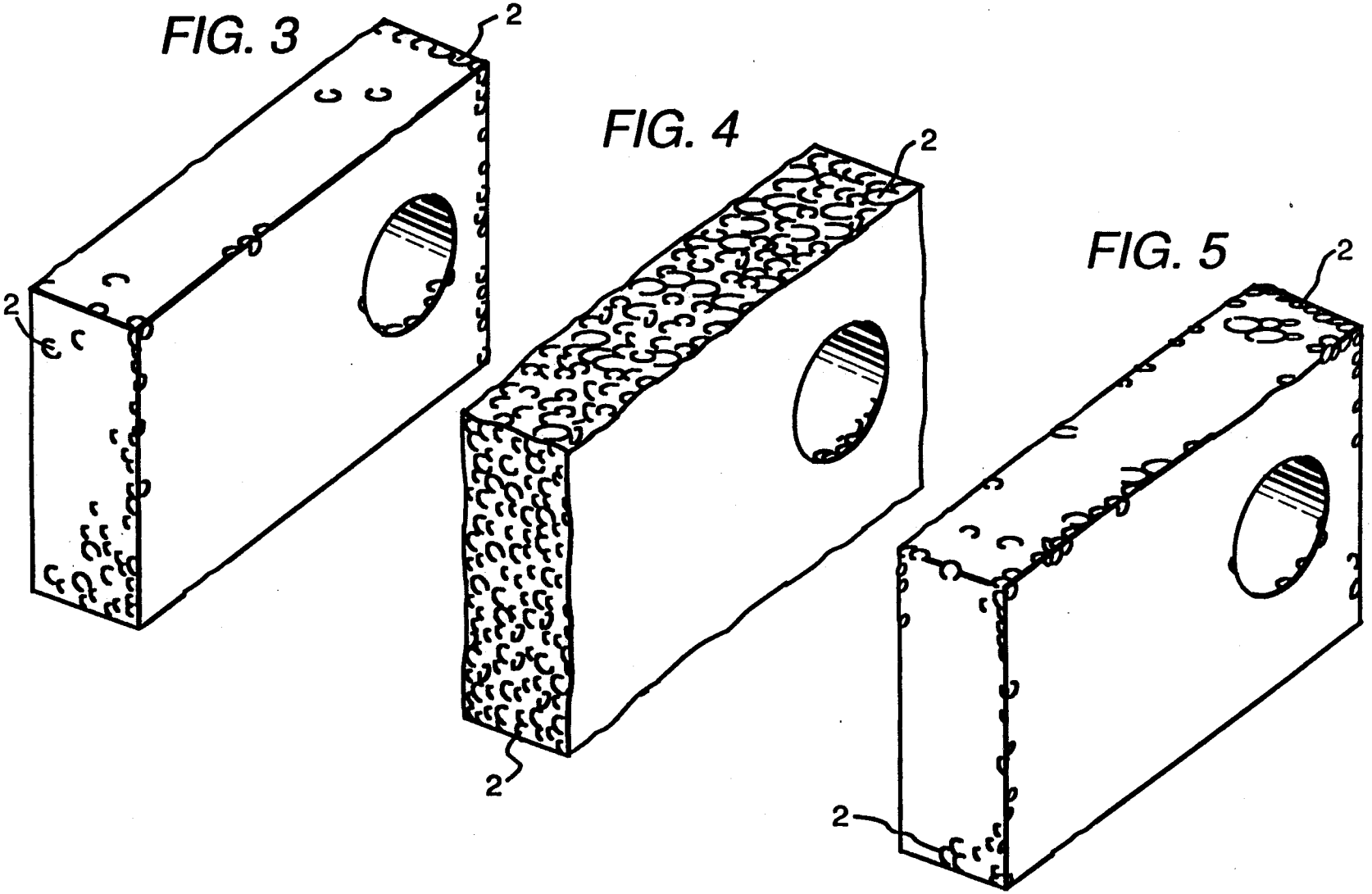
FIGS. 3–5 are perspective view line drawings reproducing a photograph of Zircaloy coupons that were exposed in the high-pressure steam test.

A first coupon was recrystallization annealed at about 575° C. in an argon atmosphere for 4 hours. A second coupon was recrystallization annealed at about 575° C. in an atmosphere comprised of about 20 volume percent oxygen and the balance argon. A uniform black oxide film was formed on the second coupon. A third coupon of the as-rolled plate, the first coupon, and the second coupon were corrosion tested in the high-pressure steam test. The results of the testing are shown in FIGS. 3–5. FIGS. 3–5 are perspective view line drawings of a photograph of the coupons after the high pressure steam test. Although not exact duplications, the line drawings are representative of the nodular corrosion found on the samples after the high-pressure steam test. The samples exhibited a black uniform corrosion, not shown, and various amounts of the localized white nodular corrosion bloom 2, shown as the circular areas on FIGS. 3–5.

FIG. 3 shows that a minor amount of nodular corrosion 2 was formed on the third coupon, tested in the as rolled condition. FIG. 4 shows a greatly increased amount of nodular corrosion 2 formed on the first coupon, tested after recrystallization annealing in argon. The nodular corrosion 2 on the first coupon substantially covered the surfaces in the thickness dimension of the coupon. FIG. 5 shows that a minor amount of nodular corrosion 2 was formed on the second coupon recrystallization annealed in the atmosphere comprised of oxygen and argon. The minor amount of nodular corrosion on the second coupon was comparable to the amount of nodular corrosion formed on the third coupon.

FIGS. 3–5 show that the reduction in nodular corrosion resistance found in annealed Zircaloy members is mitigated by annealing according to the method of this invention. As a result Zircaloy members can be recovery, partial recrystallization, or full recrystallization annealed by the method of this invention to obtain desired ductility, toughness, and creep resistance properties while at the same time maintaining the good nodular corrosion resistance found in the cold worked or beta quenched crystal structures. The corrosion resistance of cold worked or beta quenched Zircaloy is diminished by the prior art annealing methods as shown in FIG. 1.

What is claimed is:

1. A method for annealing a Zircaloy member having a cold worked or beta quenched crystal structure to mitigate the reduction in nodular corrosion resistance caused by the anneal comprising, annealing the member to form an adherent black oxide thereon, in an atmosphere consisting essentially of an effective amount of oxygen to form the black oxide and the balance an inert atmosphere.

2. A method according to claim 1 wherein the atmosphere is flowing and comprised of at least 0.1 volume percent oxygen.

3. A method according to claim 1 wherein the atmosphere is contained and comprised of at least 0.1 gram of oxygen per square meter surface area of the Zircaloy member.

4. A method according to claim 1 wherein the atmosphere is comprised of less than 20 parts per million nitrogen, less than 2 parts per million hydrogen, and less than 10 parts per million water.

5. A method for recrystallization annealing a Zircaloy member having a cold worked or beta quenched crystal structure to mitigate the reduction in nodular corrosion resistance caused by the recrystallization anneal comprising, recrystallization annealing the member to form an adherent black oxide thereon, in an atmosphere consisting essentially of an effective amount of oxygen to form the black oxide and the balance an inert atmosphere.

6. A method according to claim 5 wherein the atmosphere is flowing and comprised of at least 0.1 volume percent oxygen.

7. A method according to claim 5 wherein the atmosphere is contained and comprised of at least 0.1 gram of oxygen per square meter surface area of the Zircaloy member.

8. A method according to claim 5 wherein the atmosphere is comprised of less than 20 parts per million nitrogen, less than 2 parts per million hydrogen, and less than 10 parts per million water.

* * * * *